US011448243B2

(12) United States Patent
Orth et al.

(10) Patent No.: US 11,448,243 B2
(45) Date of Patent: Sep. 20, 2022

(54) ELECTROHYDRAULIC SYSTEM FOR USE UNDER WATER, COMPRISING AN ELECTROHYDRAULIC ACTUATOR

(71) Applicant: Robert Bosch GmbH, Stuttgart (DE)

(72) Inventors: Alexandre Orth, Waldbuettelbrunn (DE); Gottfried Hendrix, Gemuenden (DE)

(73) Assignee: Robert Bosch GmbH, Stuttgart (DE)

( * ) Notice: Subject to any disclaimer, the term of this patent is extended or adjusted under 35 U.S.C. 154(b) by 65 days.

(21) Appl. No.: 16/605,183

(22) PCT Filed: Apr. 6, 2018

(86) PCT No.: PCT/EP2018/058888
§ 371 (c)(1),
(2) Date: Oct. 14, 2019

(87) PCT Pub. No.: WO2018/192783
PCT Pub. Date: Oct. 25, 2018

(65) Prior Publication Data

US 2021/0190099 A1 Jun. 24, 2021

(30) Foreign Application Priority Data

Apr. 19, 2017 (DE) ..... 10 2017 206 596.6

(51) Int. Cl.
*F15B 15/18* (2006.01)
*E21B 34/04* (2006.01)
*F15B 7/00* (2006.01)

(52) U.S. Cl.
CPC ..... *F15B 15/18* (2013.01); *E21B 34/04* (2013.01); *F15B 7/006* (2013.01); *F15B 2211/20515* (2013.01); *F15B 2211/20561* (2013.01)

(58) Field of Classification Search
CPC ..... E21B 33/0355; E21B 34/04; F15B 1/021; F15B 15/1461; F15B 15/1471; F15B 15/18; F15B 15/226; F15B 15/228; F15B 21/066
See application file for complete search history.

(56) References Cited

U.S. PATENT DOCUMENTS 2,942,581 A * 6/1960 Gaffney ..... F15B 15/18 60/388
3,572,032 A 3/1971 Terry
(Continued)

FOREIGN PATENT DOCUMENTS

DE 10 2015 213 695 A1 2/2016
EP 2101061 A1 * 9/2009 ..... F15B 15/18
(Continued)

OTHER PUBLICATIONS

International Search Report corresponding to PCT Application No. PCT/EP2018/058888, dated Jul. 2, 2018 (German and English language document) (5 pages).

*Primary Examiner* — Michael Leslie
*Assistant Examiner* — Matthew Wiblin
(74) *Attorney, Agent, or Firm* — Maginot, Moore & Beck LLP

(57) ABSTRACT

An electrohydraulic system for use under water includes an electrohydraulic actuator and a container. A hydraulic cylinder or a hydraulic motor and a hydraulic machine are arranged in an internal space of the container. The hydraulic machine is mechanically coupled to a rotary drive unit for a common rotary movement, and the hydraulic machine adjusts the hydraulic cylinder or the hydraulic motor. The rotary drive unit is arranged outside the container and is configured to couple to and decouple from the hydraulic machine. A device in one embodiment includes the electrohydraulic system.

13 Claims, 6 Drawing Sheets

(56) References Cited

U.S. PATENT DOCUMENTS

| | | | | |
|---|---|---|---|---|
| 4,500,066 | A * | 2/1985 | Trassl | F15B 15/18 251/26 |
| 9,988,129 | B2 * | 6/2018 | Jamieson | B63G 8/001 |
| 2014/0131049 | A1 * | 5/2014 | Bourgeau | E21B 33/063 166/363 |
| 2015/0104328 | A1 * | 4/2015 | Babbitt | F04D 13/086 417/2 |
| 2019/0085651 | A1 * | 3/2019 | Phielipeit-Spiess | E21B 33/0385 |

FOREIGN PATENT DOCUMENTS

| | | | | |
|---|---|---|---|---|
| JP | H07-223589 | A | 8/1995 | |
| WO | WO-2004065068 | A1 * | 8/2004 | B25B 21/002 |

* cited by examiner

ELECTROHYDRAULIC SYSTEM FOR USE UNDER WATER, COMPRISING AN ELECTROHYDRAULIC ACTUATOR

This application is a 35 U.S.C. § 371 National Stage Application of PCT/EP2018/058888, filed on Apr. 6, 2018, which claims the benefit of priority to Serial No. DE 10 2017 206 596.6, filed on Apr. 19, 2017 in Germany, the disclosures of which are incorporated herein by reference in their entirety.

BACKGROUND

The disclosure relates to an electrohydraulic system for use under water, in particular in great depths of water, having an electrohydraulic actuator. The electrohydraulic actuator serves in particular for actuating underwater instruments. The system comprises a container, which an internal space, which is provided for forming a volume which is closed to the environment and is provided for receiving a hydraulic pressure fluid. The system furthermore comprises a hydraulic cylinder and a hydraulic machine, which are arranged in the interior of the container.

Such electrohydraulic systems are predominantly used to move an element under water in depths of water of up to several thousand meters in connection with the delivery of crude oil and natural gas, mining, scientific investigations or infrastructure projects. In this regard, for example in the case of crude oil or natural gas delivery installations at sea, process valves, by means of which the volume flow of the medium to be delivered can be regulated or shut-off, are located at great depths.

An electrohydraulic system can be constructed with an electrohydraulic actuator, which comprises a container in the internal space of which a hydrostatic machine, which can be operated at least as a pump, and an electric machine mechanically coupled to the hydrostatic machine, are arranged. In this case, the main drive of the actuator is realized by an electric motor, which drives the pump and thereby adjusts a hydraulic cylinder with a linear movement. The electric motor uses a considerable amount of electrical energy, which has to be supplied via undersea cables, for example. The actuator adjusts large production instruments of oil or gas wells, for example, which regulate the delivery quantity. So that a process valve can also be actuated manually by a robot, for example by a remote operated vehicle (ROV) or an autonomous underwater vehicle (AUV), for example in an emergency, a manual interface is present on the container, from which a rod is coupled to a piston in the cylinder. In the interface, the rod can have a movement thread and cooperate with an axially secured nut which is provided with an internal thread and is rotated to actuate the process valve. The disadvantage of this arrangement is the complexity of the system. A large installation space is required here. Moreover, the limited useful life is a problem. Furthermore, manual actuation conflicts with frequent adjustment of a process valve during operation. Moreover, the mechanical arrangement is sensitive to shocks and vibrations, which can be caused by the underwater vehicle.

Starting from this, the object of the present disclosure is to provide an electrohydraulic system and a device which mitigate or even prevent the said disadvantages. In particular, a compact design, namely a small installation space, and an increased useful life should be realized in a structurally simple manner. Moreover, frequent adjustment of the actuator should be enabled in a simple manner.

SUMMARY

These objects are achieved by an electrohydraulic system and by a device according to the disclosure. Further configurations of the disclosure are indicated in the dependent claims. It should be pointed out that the description, in particular in connection with the figures, reveals further details and further developments of the disclosure which can be combined with the features from the claims.

Conducive to this is an electrohydraulic system for use under water, having an electrohydraulic actuator and having a container, wherein a hydraulic cylinder or a hydraulic motor and a hydraulic machine are present in an internal space of the container. A rotary drive unit is mechanically coupled to the hydraulic machine for a common rotary movement. The hydraulic machine can adjust the hydraulic cylinder and/or hydraulic motor. The rotary drive unit is arranged outside the container and is designed for coupling to the hydraulic machine and for decoupling from the hydraulic machine.

The electrohydraulic system presented here, having the electrohydraulic actuator, has the advantage that a smaller installation space and an increased useful life are combined in a structurally simple manner. In particular, frequent adjustment by the underwater vehicle, for example a robot, is enabled. Finally, undesired shocks and vibrations on the hydraulic cylinder, which can occur as a result of the underwater vehicle, can be prevented.

The rotary drive unit is preferably used for the mechanical emergency adjustment of the hydraulic cylinder. The rotary drive unit serves for the continuous adjustment of the hydraulic cylinder.

The hydraulic cylinder is advantageously a differential cylinder. The hydraulic cylinder is preferably a synchronizing cylinder.

The hydraulic cylinder is preferably formed with a longitudinally displaceable piston for adjusting a process valve.

The hydraulic cylinder preferably comprises a helical pressure spring for resetting the hydraulic cylinder.

At least one solenoid valve is preferably arranged in such a way that the second cylinder chamber of the hydraulic cylinder is hydraulically balanced in the event of an electrical power failure.

It can be expedient that an electrical interface is provided and is designed for the emergency stop such that it (only) actuates the safety valves and status monitoring via the (provided) sensors (displacement sensors, position indicators, pressure sensors, temperature sensors, etc.).

Seat valves or non-return valves and/or hydraulic shut-off valves can be arranged in such a way that the position of the hydraulic cylinder remains (substantially) unaltered or is maintained when the rotary drive unit is decoupled.

At least one pressure limiting valve can be provided, which is arranged and designed in such a way that the maximum hydraulic system pressure can be effectively limited.

The hydraulic machine is preferably formed as a hydrostatic gear. The hydraulic machine can preferably be operated as a hydraulic pump.

The rotary drive unit expediently comprises an electric motor. The electric motor can be provided outside the container (in the seawater region). It is possible to provide a separate electric motor within the container as an additional drive.

A remote-controlled underwater vehicle advantageously comprises the rotary drive unit. The rotary drive unit is preferably a torque tool of an underwater robot.

A coupling unit is preferably present between the rotary drive unit and the hydraulic machine.

According to a further aspect, a device for arranging under water and for controlling a deliverable volume flow of a gaseous or liquid medium is proposed, which is constructed with a process valve. The process valve has a process valve housing, a process valve gate, with which the volume can be controlled. A hydraulic cylinder is furthermore provided, which is associated with the process valve housing and can be moved with the process valve gate. The device moreover has an electrohydraulic system having an electrohydraulic actuator, wherein a rotary drive unit is arranged on a remote-controlled underwater vehicle which drives a hydraulic pump, which adjusts the hydraulic cylinder. A rotational hydraulic motor is advantageously used instead of the hydraulic cylinder. Please refer to the following descriptions for a description of the design and the function of the electrohydraulic system.

BRIEF DESCRIPTION OF THE DRAWINGS

The invention disclosure and the technical sphere are explained in more detail below with reference to figures. In these, the same components are denoted by the same reference signs. The illustrations are schematic and are not intended to demonstrate size ratios. The explanations provided in regard to individual details of a figure can be extracted and freely combined with the content of other figures or the description above, unless the person skilled in the art is directed otherwise or such a combination is explicitly excluded here. The figures show schematically:

DETAILED DESCRIPTION

Figure 1:
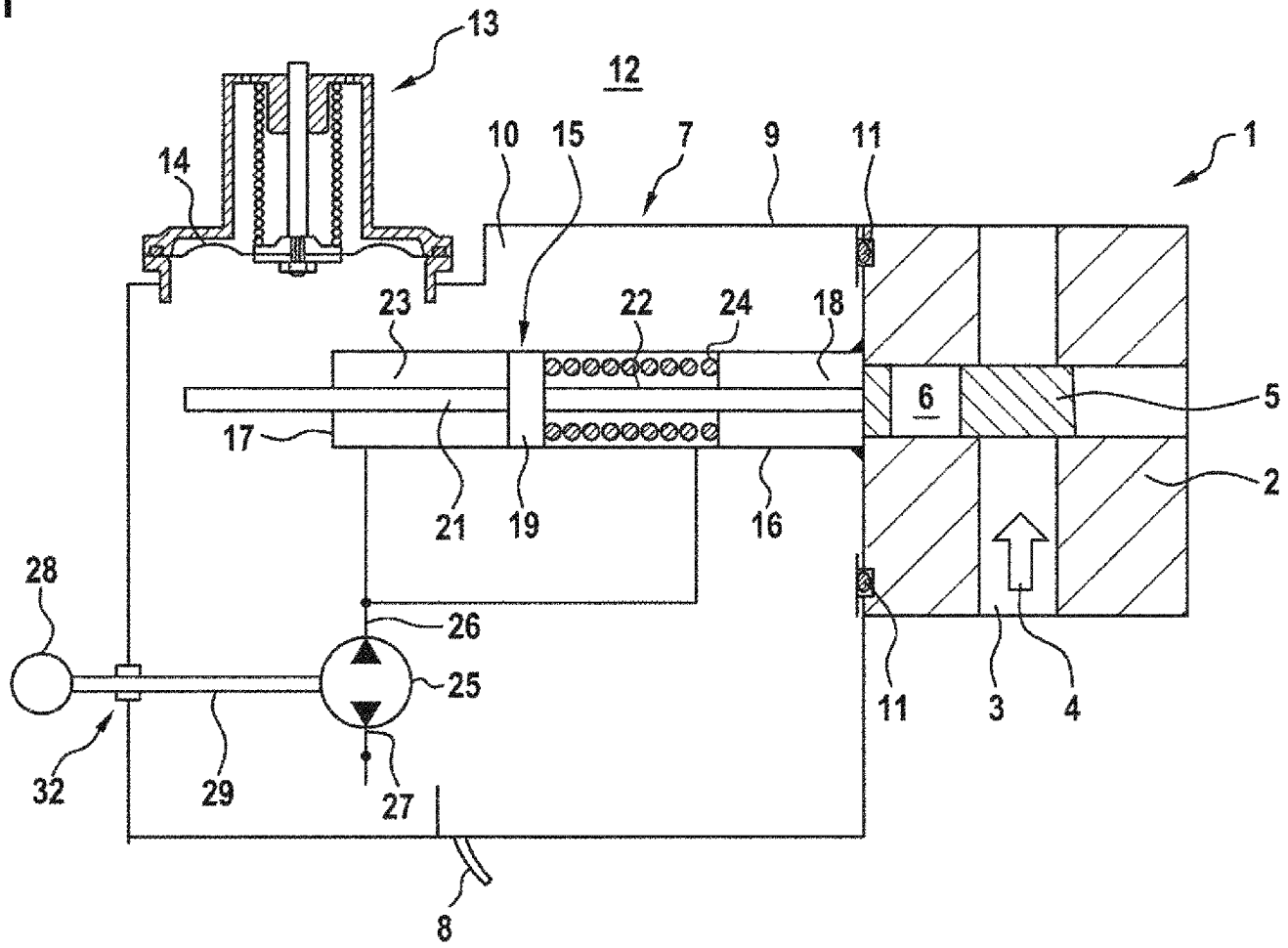
Figure 2:
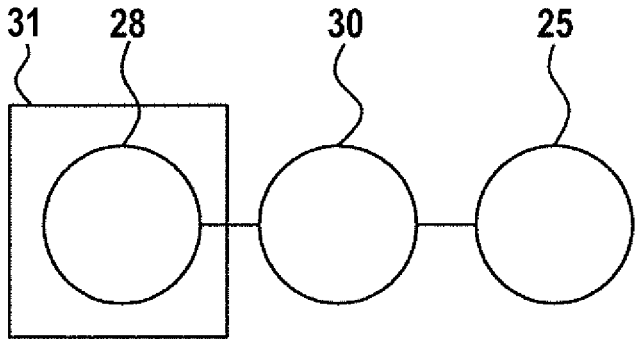
Figure 3:
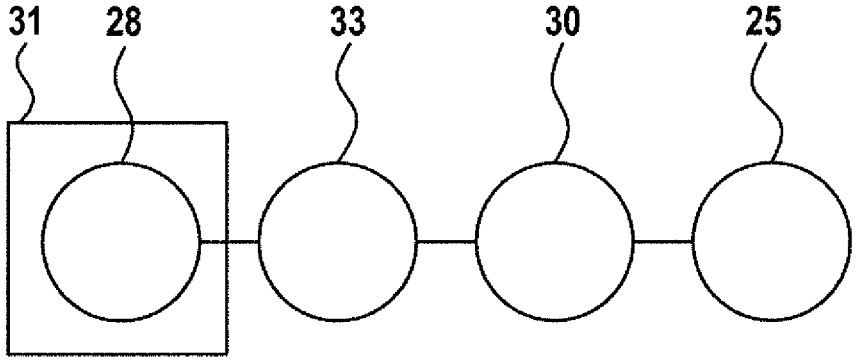
Figure 4:
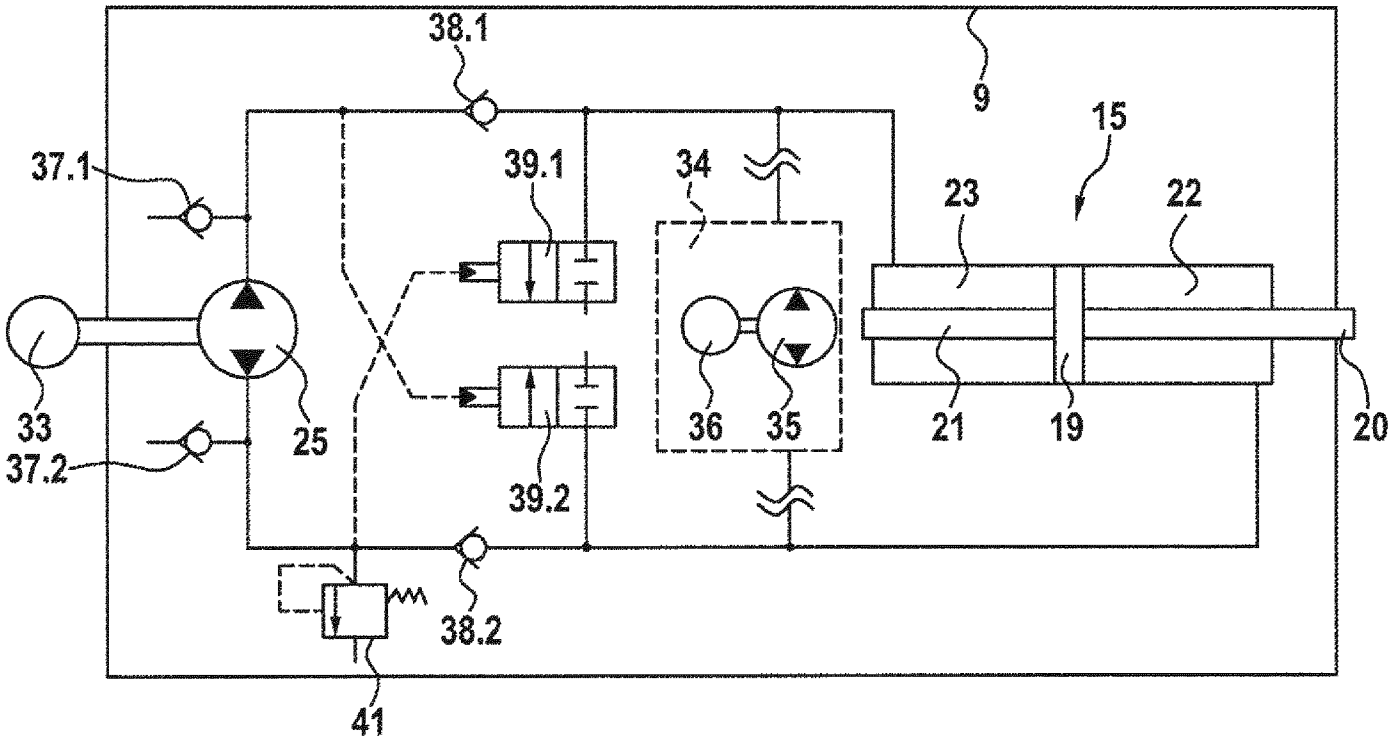
Figure 5:
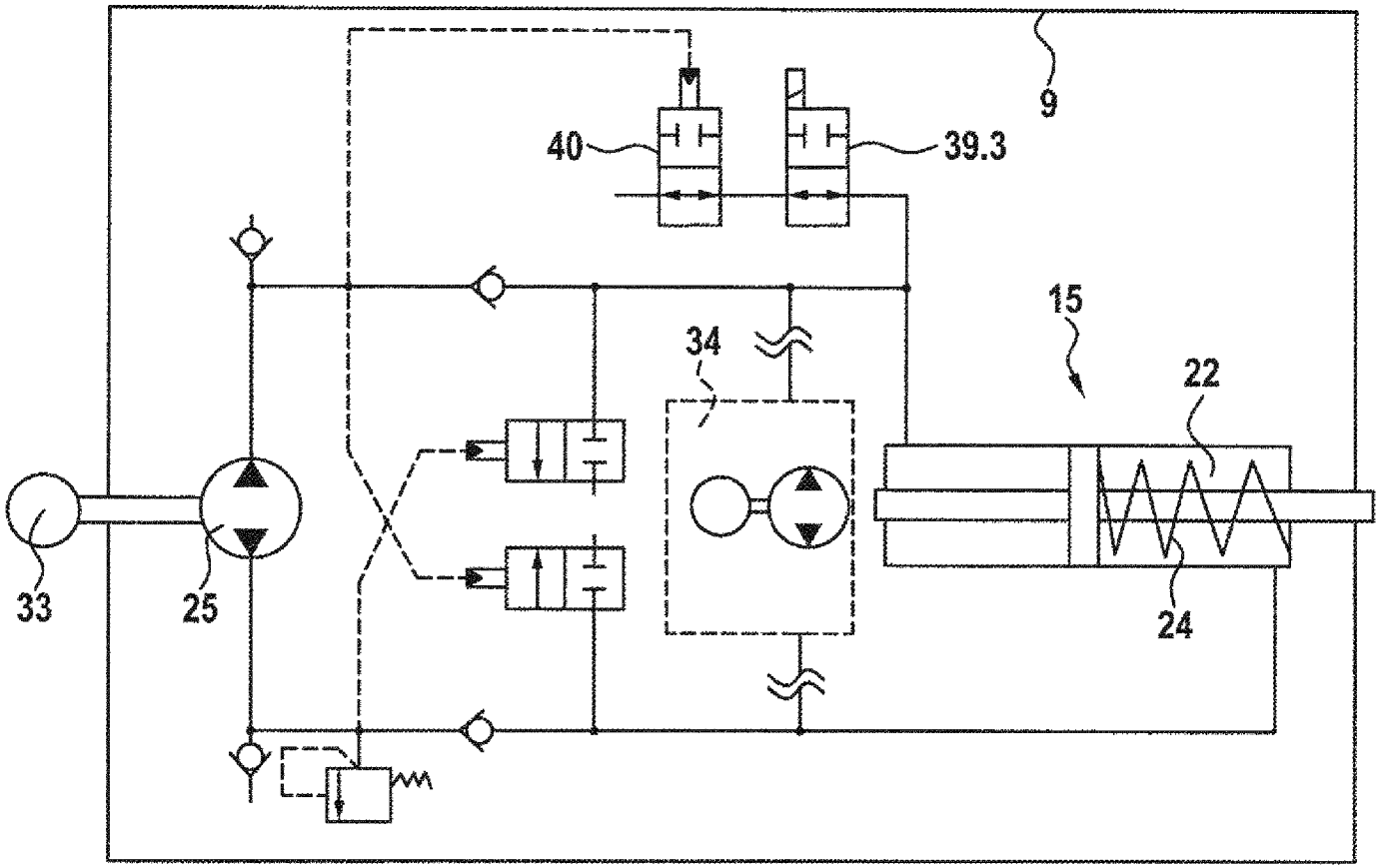
Figure 6:
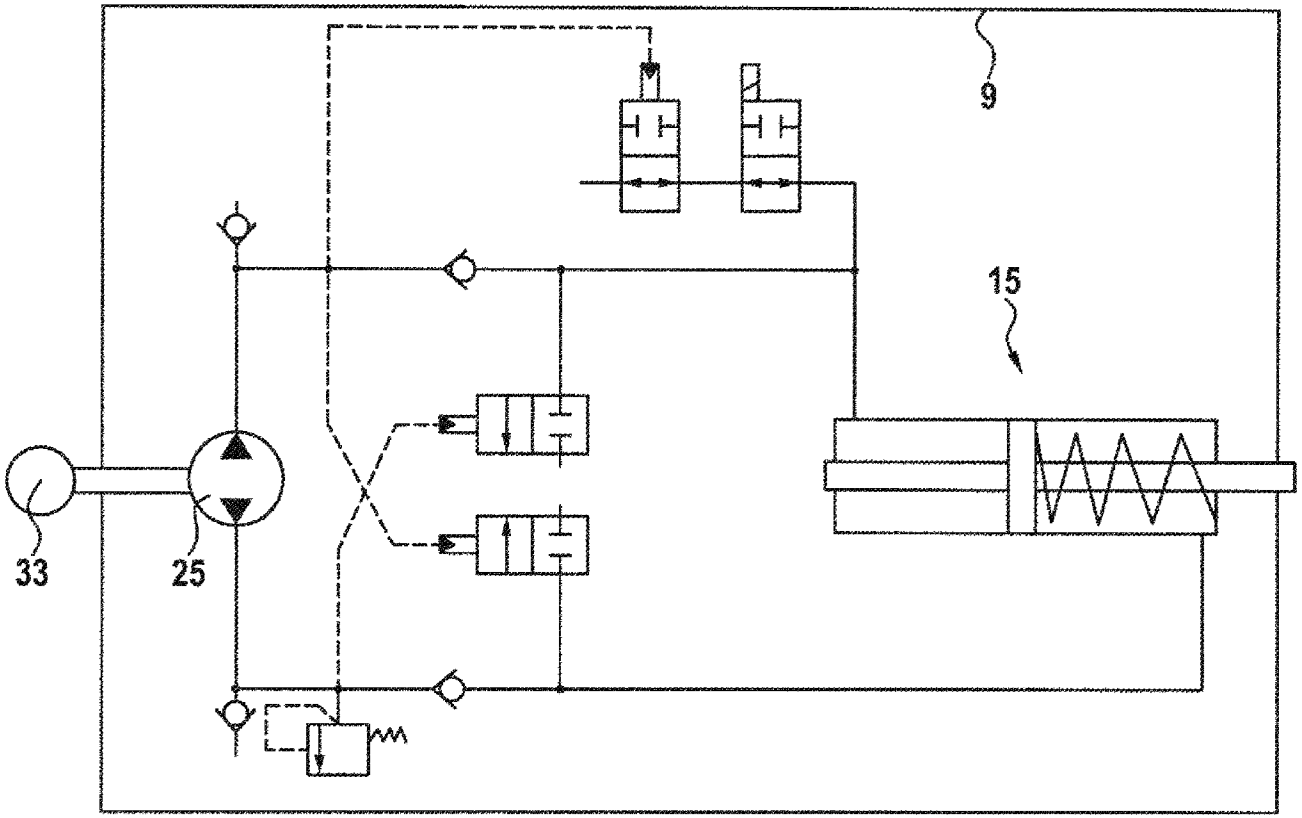
Figure 7:
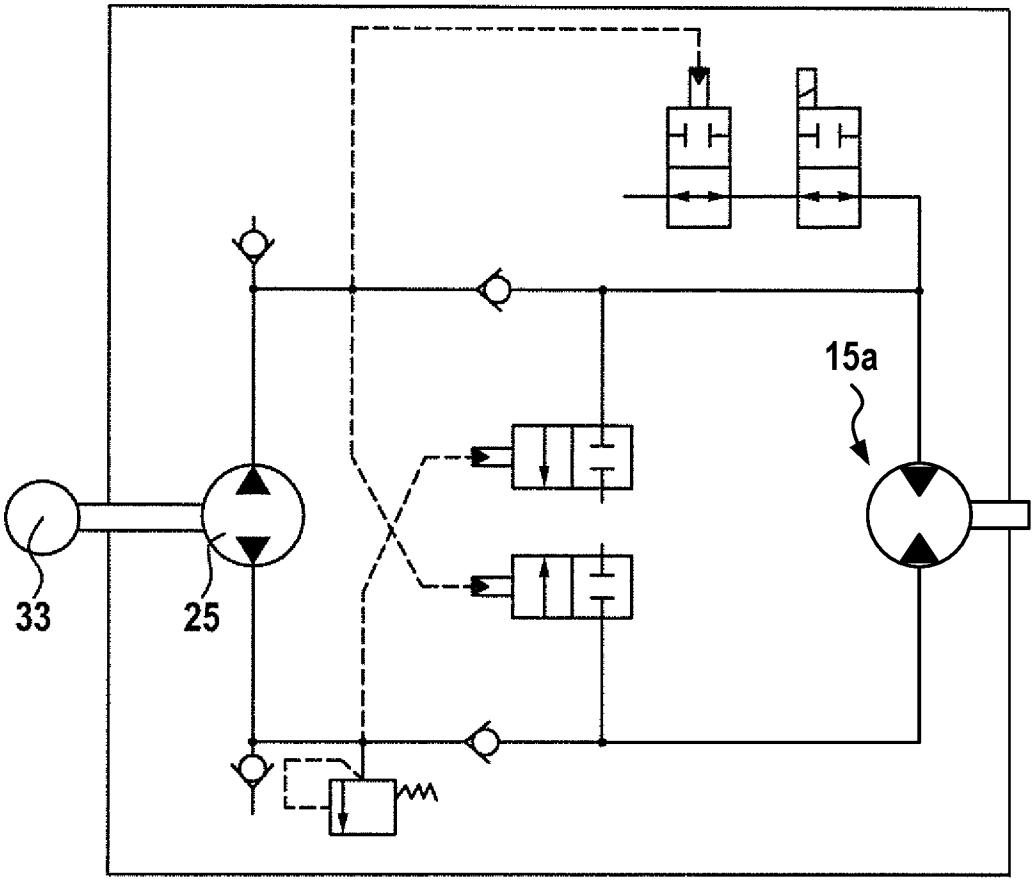

FIG. 1 a side view of the device with a closed process valve;

FIG. 2 a block diagram with a rotary drive unit, torque transmission and hydraulic machine;

FIG. 3 a block diagram as in FIG. 2, but with a coupling unit;

FIG. 4 a first embodiment with an internally arranged main drive for a hydraulic cylinder without a pressure spring;

FIG. 5 a second embodiment with an internally arranged main drive for a hydraulic cylinder with a pressure spring;

FIG. 6 a third embodiment without an internally arranged main drive for a hydraulic cylinder; and FIG. 7 a fourth embodiment as in FIG. 6, but with a hydraulic motor instead of a hydraulic cylinder.

The exemplary embodiments, shown in the figures, of an electrohydraulic system have, according to FIG. 1, a process valve 1 having a process valve housing 2 through which a process valve channel 3 passes, which process valve channel is continued at its openings by pipes (not illustrated) and in which a gaseous or liquid medium flows from the sea floor to a part of a drill rig which protrudes from the sea or to a drill vessel. The flow direction is indicated by the arrow 4.

Formed in the process valve housing 2 is a cavity which crosses the process valve channel 3 and in which a process valve gate 5 with a throughflow opening 6 can be moved transversely to the longitudinal direction of the process valve channel 3. In the state according to FIG. 1, the process valve channel 3 and the throughflow opening 6 in the process valve gate 5 do not overlap. The process valve is therefore closed. In one state (not illustrated), the throughflow opening 6 and the process valve channel 3 overlap substantially. The process valve 1 is almost fully open.

A process valve of the type shown and for the use described is intended, on the one hand, to be actuable in a controlled manner and, on the other, to also be conducive to safety in that, in the event of a fault, it rapidly and reliably assumes a position which corresponds to a safe state. In the present case, this safe state is a closed process valve.

The process valve 1 is actuated by a compact electrohydraulic system 7, which is arranged under water directly at the process valve 1. It suffices that only one electric cable 8 leads from the electrohydraulic system 7 to the sea surface or another superordinate electrical control located under water.

The electrohydraulic system 7 shown as an exemplary embodiment has a container 9, which is fastened to the process valve housing 2 on an open side so that an internal space 10 is present which is closed to the environment and is filled with a hydraulic pressure fluid as the working medium. For fastening to the process valve housing 2, the container 9 has, at its open side, an internal flange with which it is screwed to the process valve housing 2. A circumferential seal 11, which is inserted into a circumferential groove of the process valve housing 2, is arranged radially outside the screw connections, between the internal flange of the container 9 and the process valve housing 2.

The container 9 is pressure-compensated with respect to the environmental pressure prevailing underwater (seawater region 12). To this end, in the case of a pressure compensator 13, a membrane 14 is tightly clamped in an opening in the container wall. Holes are located in the cover so that the space between the membrane 14 and the cover is part of the environment and is filled with seawater. The internal space 10 is therefore sealed off from the environment by the membrane 14. The membrane 14 is acted on by the pressure in the internal space 10 at its first surface, which faces the internal space 10, and by the pressure prevailing in the environment at its second surface, which faces the cover and is approximately the same size as the first surface, and which always attempts to assume a position and shape in which the sum of all forces exerted on it is zero.

A hydraulic cylinder 15 having a cylinder housing 16 is present in the internal space 10 of the container 9, which cylinder housing is closed at the end faces by a cylinder base 17 and a cylinder head 18, with a piston 19 which is displaceable in the longitudinal direction of the cylinder housing 16 in the interior of the cylinder housing 16 and with a first piston rod 20, which is securely connected to the piston 19 and projects away from the piston 19 on one side, which piston rod passes through the cylinder head 18 in a sealed manner, guided in a way which is not illustrated in more detail. The gap between the piston rod 20 and the cylinder head 18 is sealed by two seals (not illustrated) arranged at an axial spacing from one another in the cylinder head 18. The process valve gate 5 is fastened at the free end of the piston rod 20. Furthermore, a second piston rod 21, which is securely connected to the piston 19 and projects away from the piston 19 to the other side, is present, which piston rod is guided in a sealed manner and passes through the cylinder base 17. The interior of the cylinder housing 16 is divided by the piston 19 into a first cylinder chamber 22 on the cylinder-head side and into a second cylinder chamber 23 on the base side, the volumes of which depend on the position of the piston 19.

A helical pressure spring 24 is accommodated in the cylinder chamber 22, which helical pressure spring surrounds the piston rod 20 and is clamped between the cylinder head 18 and the piston 19, i.e. it acts on the piston 19 in a direction in which the piston rod 20 is retracted and the process valve gate 5 is moved for closing the process valve 1.

A hydraulic machine 25, which can be operated as a pump with two delivery directions, is also located in the internal space 10 of the container 9. The hydraulic machine 25 has a pressure connection 26 and a suction connection 27, which is open to the internal space 10. When operated as a pump, pressure fluid sucked from the internal space 10 can be delivered by the hydraulic machine 25 to the cylinder chamber 23 via the pressure connection 26. Conversely, pressure fluid can be displaced from the cylinder chamber 23 via the hydraulic machine 25 into the internal space 10 of the container 9. Within this context, the cylinder chamber 23 in the exemplary embodiment is the second cylinder chamber. Accordingly, pressure fluid sucked from the internal space 10 by the hydraulic machine 25 operating as a pump can be delivered to the cylinder chamber 22 via the pressure connection 26; conversely, pressure fluid can be displaced from the cylinder chamber 22 into the internal space 10 of the container 9 via the hydraulic machine 25. Corresponding valves are provided for this purpose, see FIGS. 4 to 6.

A rotary drive unit 28 for a common rotary movement is mechanically coupled to the hydraulic machine 25, e.g. via a shaft 29. The shaft 29 transmits a torque of the rotary drive unit 28 to the hydraulic machine 25. The rotary drive unit 28 is located outside the container 9. It is comprised, for example, by a remote-controlled underwater vehicle 31 (ROV) or a robot and preferably has an electric motor as the rotary drive unit 28.

So that the process valve 1 can be actuated by a robot, for example by an ROV, an interface 32 is present on the container 9, from which the shaft 29 is coupled to the hydraulic machine 25 in the internal space 10.

FIG. 2 schematically illustrates the torque transmission between the rotary drive unit 28 and the hydraulic machine 25. 31 denotes a remote-controlled underwater vehicle, which comprises the rotary drive unit 28.

FIG. 3 schematically shows that the rotary drive unit 28 is designed for coupling and decoupling to and from the hydraulic machine 25. To this end, a coupling unit 33, for example a clutch, is provided between the rotary drive unit 28 and the hydraulic machine 25. The means for driving the hydraulic machine 25 in a rotary manner are configured such that the leak-tightness of the internal space 10 with respect to the external seawater region 12 is ensured.

FIG. 4 shows a first embodiment having an (optionally) internally arranged main drive 34 (automated cylinder drive) for a hydraulic cylinder 15 without a pressure spring. The hydraulic cylinder 15 (actuator) operates without a spring-loaded opening and closing function. A hydrostatic gear for the linearly operating hydraulic cylinder 15 is present. The rotary drive unit 28 on the underwater vehicle 31 (see FIGS. 2 and 3) generates a torque which drives the hydraulic machine 25 (hydraulic pump). 33 denotes the coupling unit (connecting clutch). The hydraulic machine 25 adjusts the hydraulic cylinder 15. For emergency actuation for retracting and withdrawing the process valve gate 5 (see FIG. 1), the first cylinder chamber 22 shoots or opens the external process valve 1 (see FIG. 1). Furthermore present in the internal space 10 of the container 9 are: suction valves 37.1, 37.2, non-return valves 38.1, 38.2, hydraulic shut-off valves 39.1, 39.2 and a pressure limiting valve 41.

The embodiment according to FIG. 4 is structurally simple, space-saving, robust and is at little risk of seawater penetrating therein. Alternatively, another pump with an electric motor can be used, which is operated by electrical energy.

FIG. 5 shows a second embodiment having an internally arranged main drive 34 for a hydraulic cylinder 15, but with a helical pressure spring 24 in the first cylinder chamber 22. In FIG. 5—in contrast to FIG. 4—additionally present apart from the helical pressure spring 24 are: hydraulic shut-off valve 39.3 and solenoid valve 40 (normally open). This design contains a safety closure for the process valve 1 if the function of the helical pressure spring 24 is impaired or fails, e.g. in the event of breakage or the like.

FIG. 6 shows a third embodiment (somewhat simplified compared to FIG. 5), without an internally arranged main drive (see position 34 in FIGS. 4 and 5) for a hydraulic cylinder 15. The drive function for the hydraulic cylinder 15 is only realized via the external rotary drive unit 28 in conjunction with the hydraulic machine 25. This design is suitable both for emergency adjustment and—where required—for continuous adjustment during operation of the hydraulic cylinder 15. By omitting the main drive 34, this embodiment is extremely compact and necessitates only a low electrical energy consumption. Electrical energy within the electrohydraulic system is only required for safety signals and sensors. The electrical energy for the rotary drive unit 28 located outside the container 9 is independent of the energy consumption of the components within the container 9. The electrical interface illustrated above comprises only the emergency stop for actuating the safety valves and the sensor signals (position encoder, pressures, . . . ).

FIG. 7 shows a fourth embodiment that is similar to the embodiment of FIG. 6, but with a rotational hydraulic motor **15*a*** used instead of the hydraulic cylinder.

LIST OF REFERENCE SIGNS

1 Process valve
2 Process valve housing
3 Process valve channel
4 Arrow
5 Process valve gate
6 Throughflow opening
7 Electrohydraulic system
8 Cable
9 Container
10 Internal space of 9
11 Seal
12 Seawater region
13 Pressure compensator
14 Membrane
15 Hydraulic cylinder
16 Cylinder housing
17 Cylinder base
18 Cylinder head
19 Piston
20 First piston rod
21 Second piston rod
22 First cylinder chamber
23 Second cylinder chamber
24 Helical pressure spring
25 Hydraulic machine
26 Pressure connection
27 Suction connection
28 Rotary drive unit
29 Shaft
30 Torque transmission
31 Remote-controlled underwater vehicle

32 Interface
33 Coupling unit
34 Main drive of 15
35 Hydraulic pump
36 Electric motor
37.1 Suction valve
37.2 Suction valve
38.1 Non-return valve
38.2 Non-return valve
39.1 Hydraulic shut-off valve
39.2 Hydraulic shut-off valve
39.3 Hydraulic shut-off valve
40 Solenoid valve
41 Pressure limiting valve

The invention claimed is:

1. An electrohydraulic system for use under water, comprising:

a container having an internal space; and an electrohydraulic actuator comprising:

a hydraulic cylinder or motor;

a hydraulic machine arranged in the internal space of the container, the hydraulic machine configured to adjust at least the hydraulic cylinder or hydraulic motor and configured to be operated with two delivery directions;

a rotary drive unit mechanically coupled to the hydraulic machine for a common rotary movement, the rotary drive unit configured to adjust at least the hydraulic cylinder or motor, the rotary drive unit including a first electric motor;

a hydraulic main drive arranged in the internal space of the container, the hydraulic main drive including a second electric motor configured to drive a pump so as to actuate the hydraulic cylinder or motor; and at least one non-return valve or at least one hydraulic shut-off valve configured such that a position of the hydraulic cylinder or motor remains unaltered when the rotary drive unit is decoupled and the hydraulic main drive is deactivated, wherein the rotary drive unit is arranged outside the container and is configured to couple to the hydraulic machine and decouple from the hydraulic machine, and wherein the electrohydraulic system is configured such that electrical energy for the rotary drive unit is independent of energy consumption of components in the container.

2. The electrohydraulic system as claimed in claim 1, wherein the hydraulic cylinder or motor is a hydraulic cylinder, and the rotary drive unit and the hydraulic main drive are configured to adjust the hydraulic cylinder.

3. The electrohydraulic system as claimed in claim 2, wherein the hydraulic cylinder is a differential cylinder or a synchronizing cylinder.

4. The electrohydraulic system as claimed in claim 2, wherein the hydraulic cylinder includes a displaceable piston configured to adjust a process valve.

5. The electrohydraulic system as claimed in claim 2, wherein the hydraulic cylinder comprises a helical pressure spring configured to reset the hydraulic cylinder.

6. The electrohydraulic system as claimed in claim 2, wherein at least one solenoid valve is arranged such that a second cylinder chamber of the hydraulic cylinder is hydraulically balanced in the event of an electrical power failure.

7. The electrohydraulic system as claimed in claim 1, further comprising at least one pressure limiting valve arranged and configured such that a maximum hydraulic system pressure is configured to be effectively limited.

8. The electrohydraulic system as claimed in claim 1, wherein the hydraulic machine is configured as a hydrostatic gear or a hydraulic pump.

9. The electrohydraulic system as claimed in claim 1, wherein a remote-controlled underwater vehicle comprises the rotary drive unit.

10. The electrohydraulic system as claimed in claim 1, further comprising a coupling unit arranged between the rotary drive unit and the hydraulic machine.

11. The electrohydraulic system as claimed in claim 1, wherein the hydraulic cylinder or motor is a rotational hydraulic motor.

12. The electrohydraulic system as claimed in claim 10, wherein the coupling unit includes a connecting clutch.

13. A device configured to be operated under water and to control a deliverable volume flow of a gaseous or liquid medium, comprising:

a process valve having a process valve housing and a process valve gate configured to control the volume flow;

an electrohydraulic system comprising:

a container having an internal space; and an electrohydraulic actuator comprising a hydraulic cylinder associated with the process valve housing, the hydraulic cylinder configured to move with the process valve gate;

a hydraulic machine arranged in the internal space, the hydraulic machine configured to adjust at least the hydraulic cylinder and configured to be operated with two delivery directions;

a rotary drive unit arranged on a remote-controlled underwater vehicle outside the container, the rotary drive unit configured to couple to and decouple from the hydraulic machine such that, when coupled thereto, the rotary drive unit drives the hydraulic machine, the rotary drive unit including a first electric motor;

a hydraulic main drive arranged in the internal space of the container, the hydraulic main drive including a second electric motor configured to drive a pump so as to actuate the hydraulic cylinder or motor; and at least one non-return valve or at least one hydraulic shut-off valve configured such that a position of the hydraulic cylinder or motor remains unaltered when the rotary drive unit is decoupled and the hydraulic main drive is deactivated, wherein the device is configured such that electrical energy for the rotary drive unit is independent of energy consumption of components in the container.

* * * * *